US005876307A

United States Patent [19]

Stearns et al.

[11] Patent Number: 5,876,307

[45] Date of Patent: Mar. 2, 1999

[54] ELLIPTICAL MOTION EXERCISE APPARATUS

[76] Inventors: Kenneth W. Stearns, 8009 Cedel, Houston, Tex. 77055; Joseph D. Maresh, 19919 White Cloud Cir., West Linn, Oreg. 97068

[21] Appl. No.: 832,630

[22] Filed: Apr. 4, 1997

[51] Int. Cl.[6] ..... A63B 22/00

[52] U.S. Cl. ..... 482/51

[58] Field of Search ..... 482/51, 52, 53, 482/57, 70, 79, 80

[56] References Cited

U.S. PATENT DOCUMENTS

| | | | |
|---|---|---|---|
| 5,039,088 | 8/1991 | Shifferen | 482/51 |
| 5,279,529 | 1/1994 | Eschenbach | 482/57 |
| 5,290,211 | 3/1994 | Stearns | 482/53 |
| 5,499,956 | 3/1996 | Habing et al. | 482/51 |
| 5,577,985 | 11/1996 | Miller | 482/51 |
| 5,605,521 | 2/1997 | Hsieh | 482/51 |
| 5,624,354 | 4/1997 | Chen | 482/51 |
| 5,707,321 | 1/1998 | Maresh | 482/51 |

*Primary Examiner*—Stephen R. Crow

[57] ABSTRACT

A four bar linkage is interconnected between a crank and a force receiving member. The linkage links rotation of the crank to generally elliptical movement of the force receiving member. The linkage includes a first link having a first end rotatably connected to the crank; a second link having a first end rotatably connected to a second, opposite end of the first link, an intermediate portion rotatably connected to the frame, and a second, opposite end rotatably connected to an intermediate portion of a fourth link; a third link having a first end rotatably connected to an intermediate portion of the first link, and a second, opposite end rotatably connected to a first end of the fourth link; and a force receiving member connected to at least one of the first link, the second link, the third link, and the fourth link.

10 Claims, 8 Drawing Sheets

ELLIPTICAL MOTION EXERCISE APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

The present invention may be seen to provide a novel linkage assembly and corresponding exercise apparatus suitable for linking circular motion to relatively more complex, generally elliptical motion. In one embodiment, for example, a four bar linkage is interconnected between a crank and a force receiving member. A first link extends outward from the linkage assembly to a distal end which is rotatably connected to the crank, and an opposite link extends outward from the linkage to a diagonally opposite distal end which is connected to the force receiving member. As the crank rotates, the linkage assembly constrains the force receiving member to travel through a generally elliptical path, having a relatively longer major axis and a relatively shorter minor axis.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
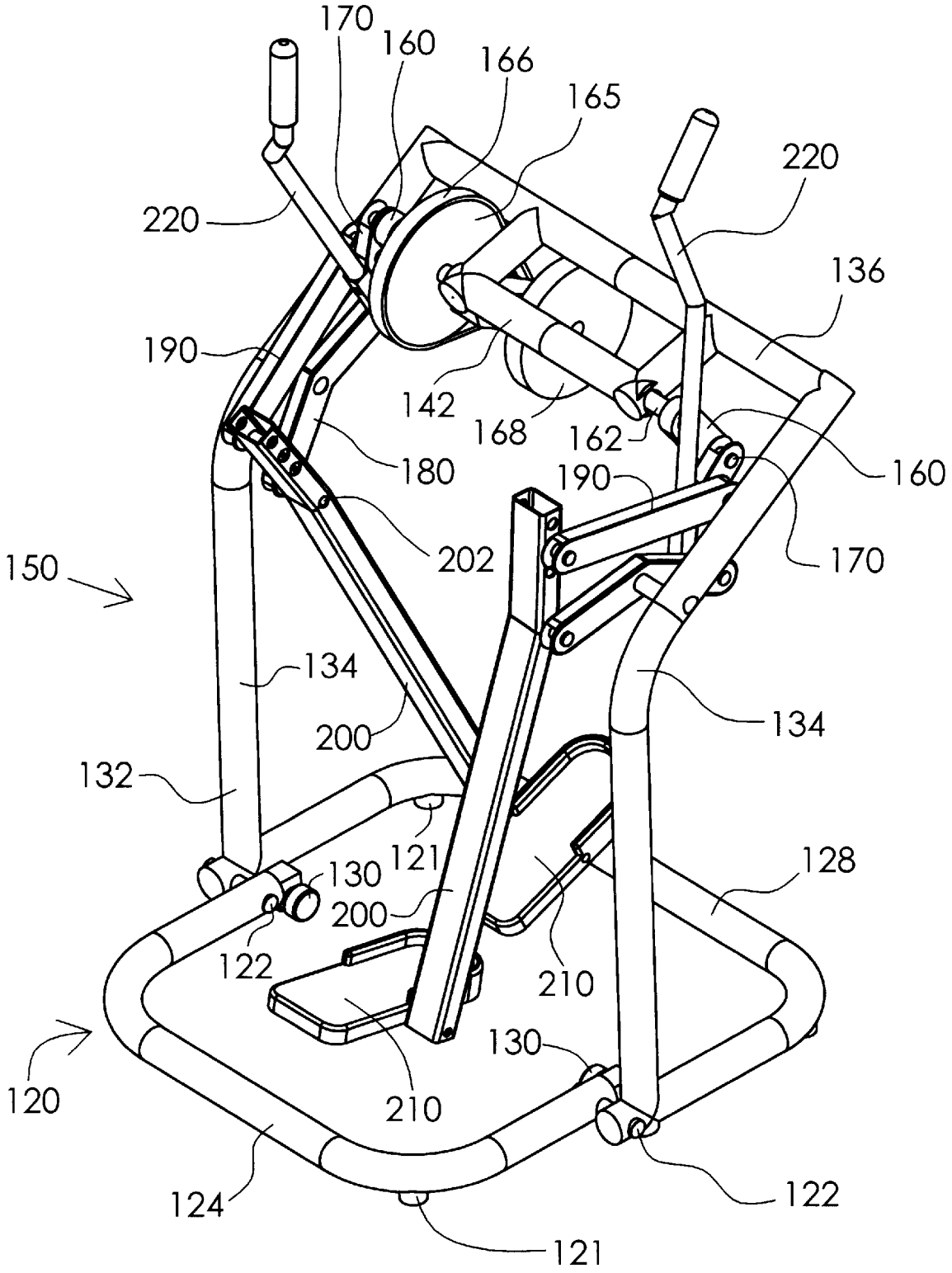
FIG. 1 is a perspective view of an exercise apparatus constructed according to the principles of the present invention.
Figure 2:
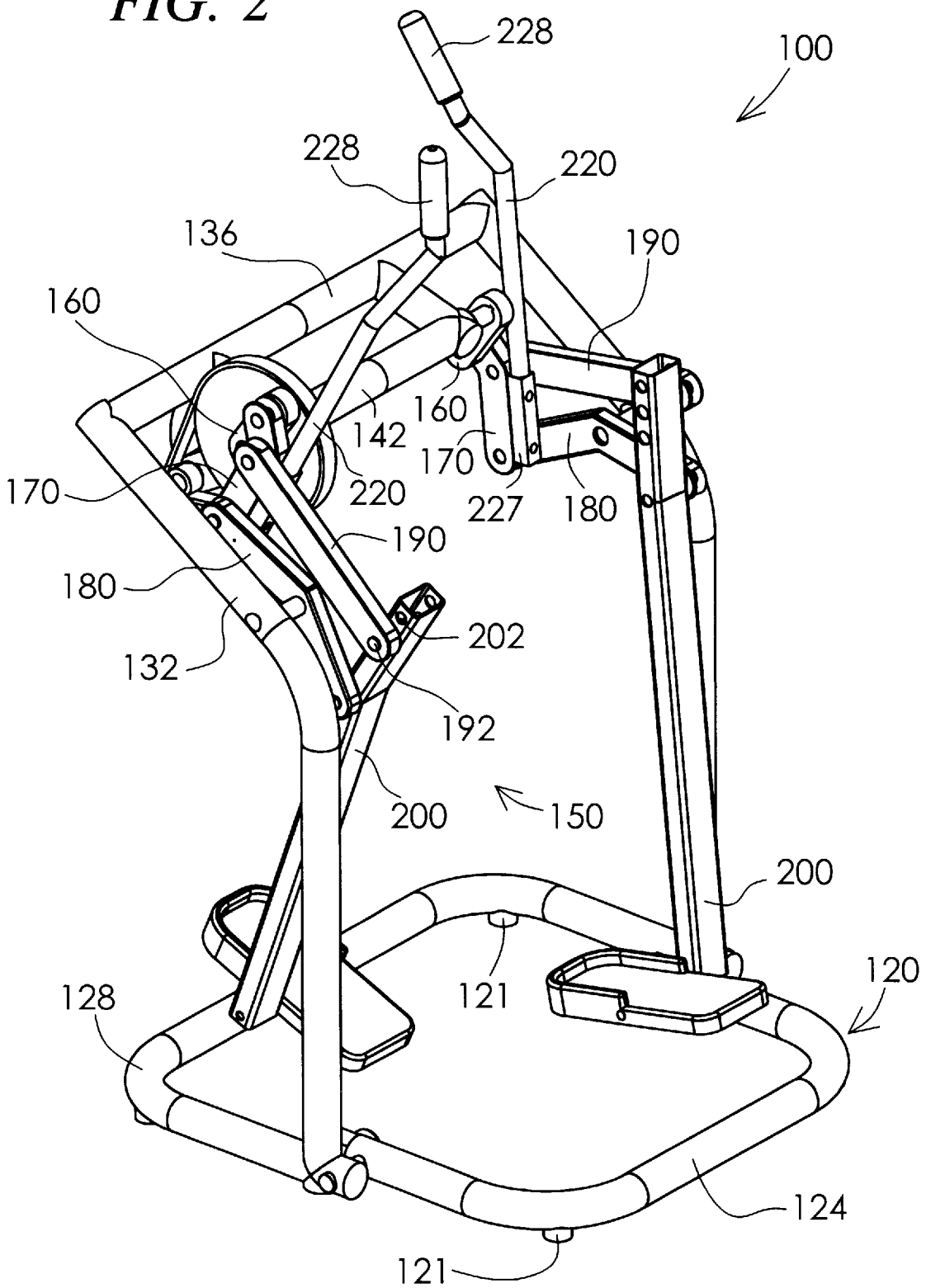
FIG. 2 is another perspective view of the exercise apparatus of FIG. 1.
Figure 3:
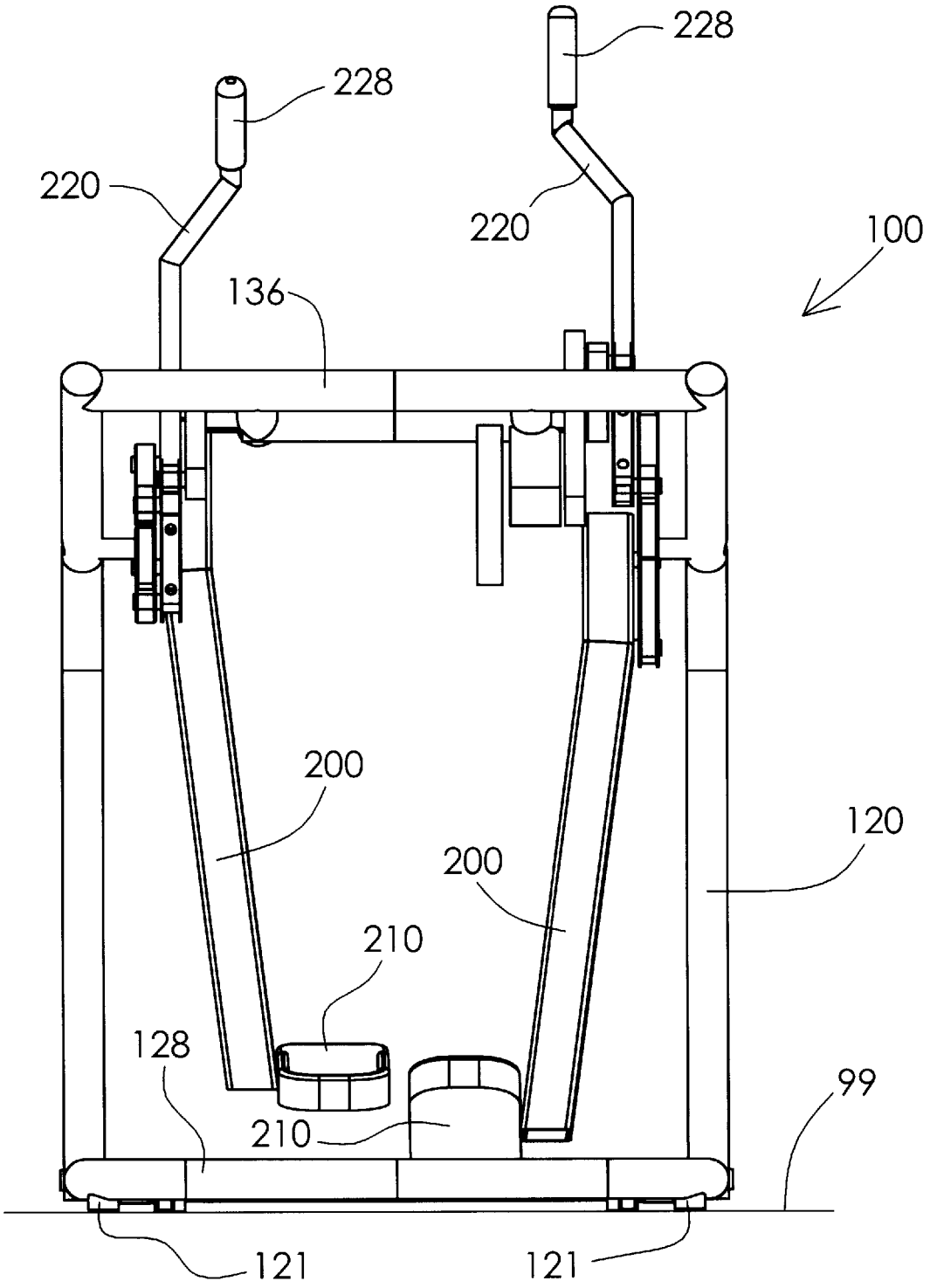
FIG. 3 is a front view of the exercise apparatus of FIG. 1.
Figure 4:
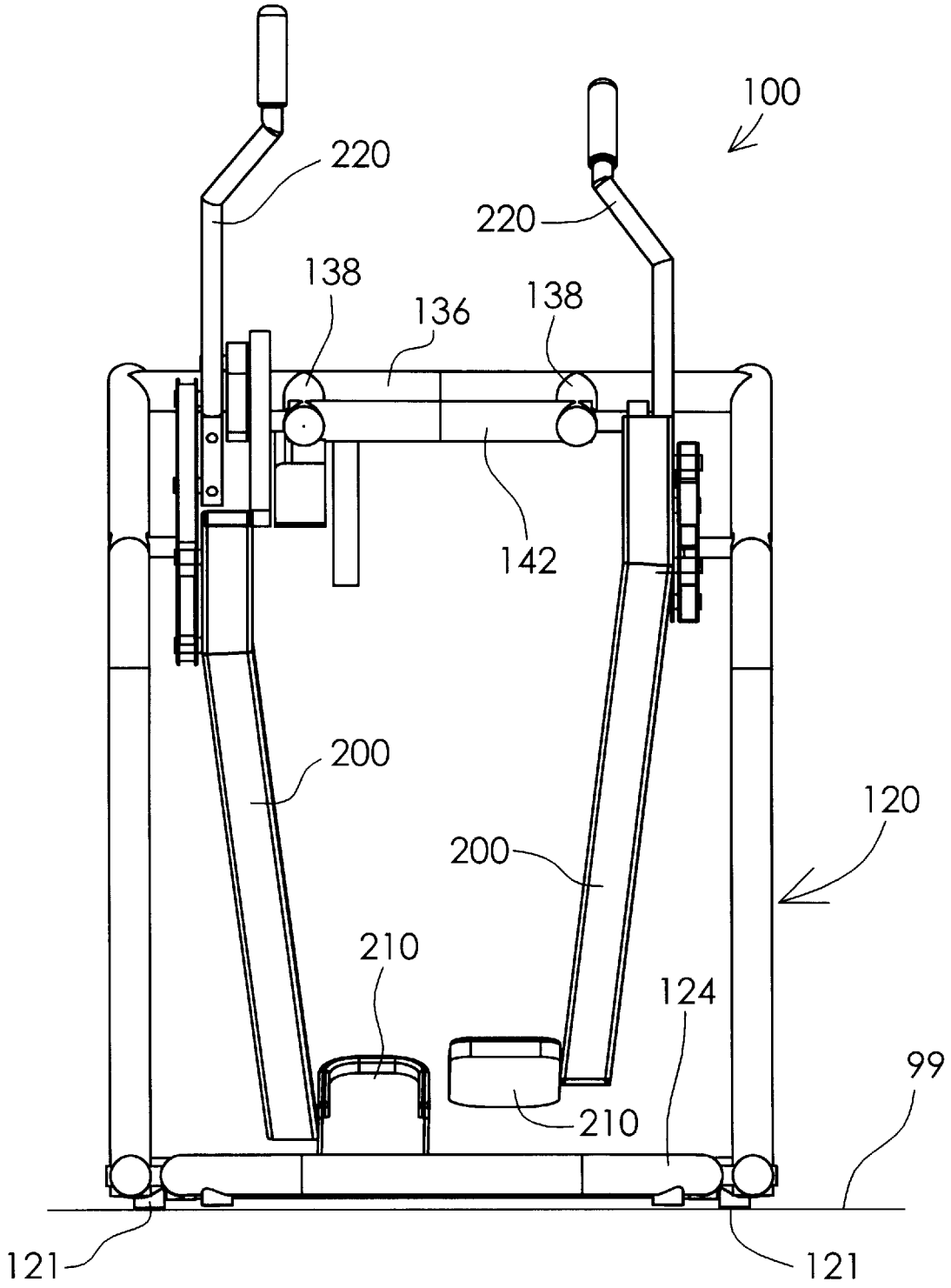
FIG. 4 is a rear view of the exercise apparatus of FIG. 1.
Figure 5:
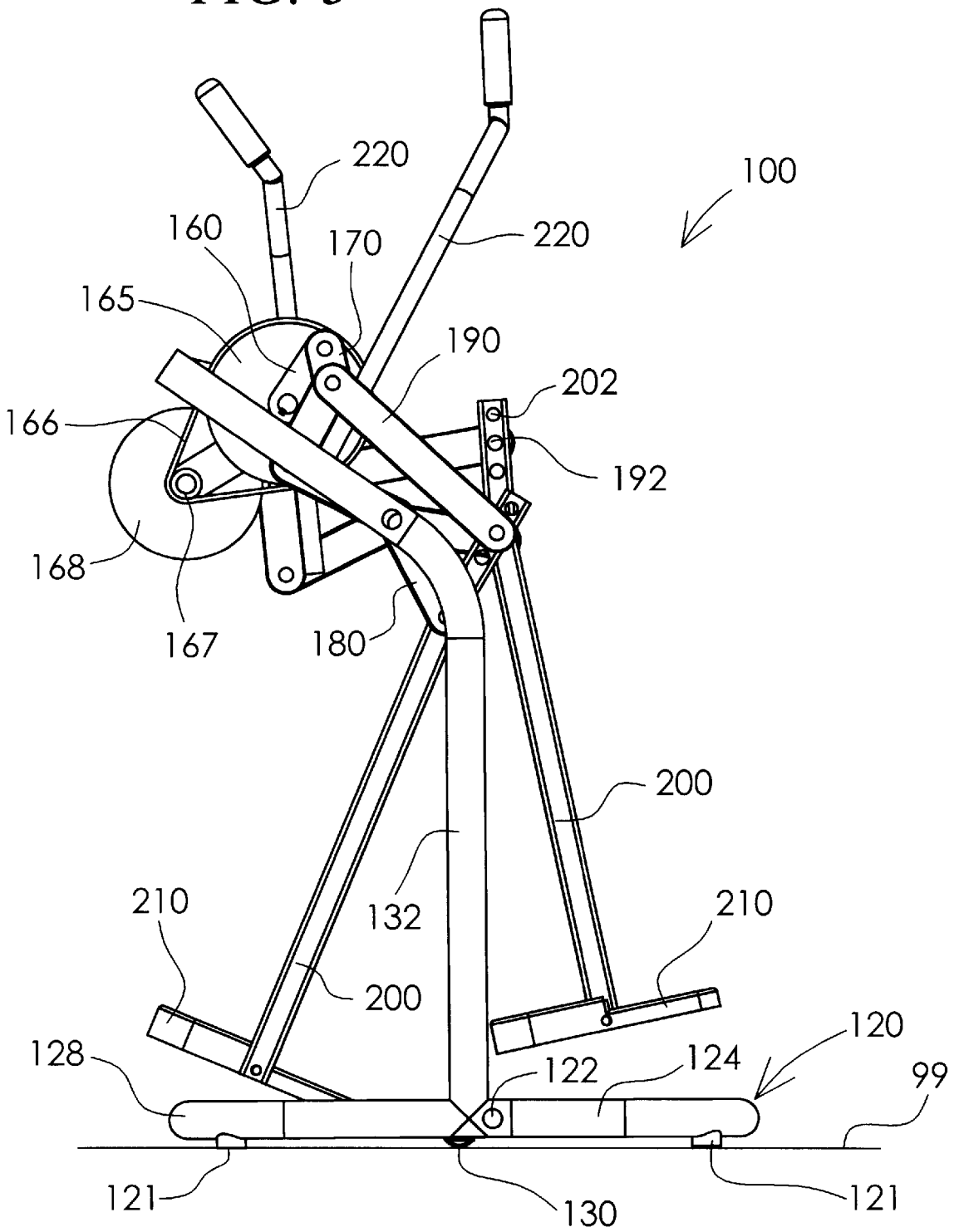
FIG. 5 is a side view of the exercise apparatus of FIG. 1.
Figure 6:
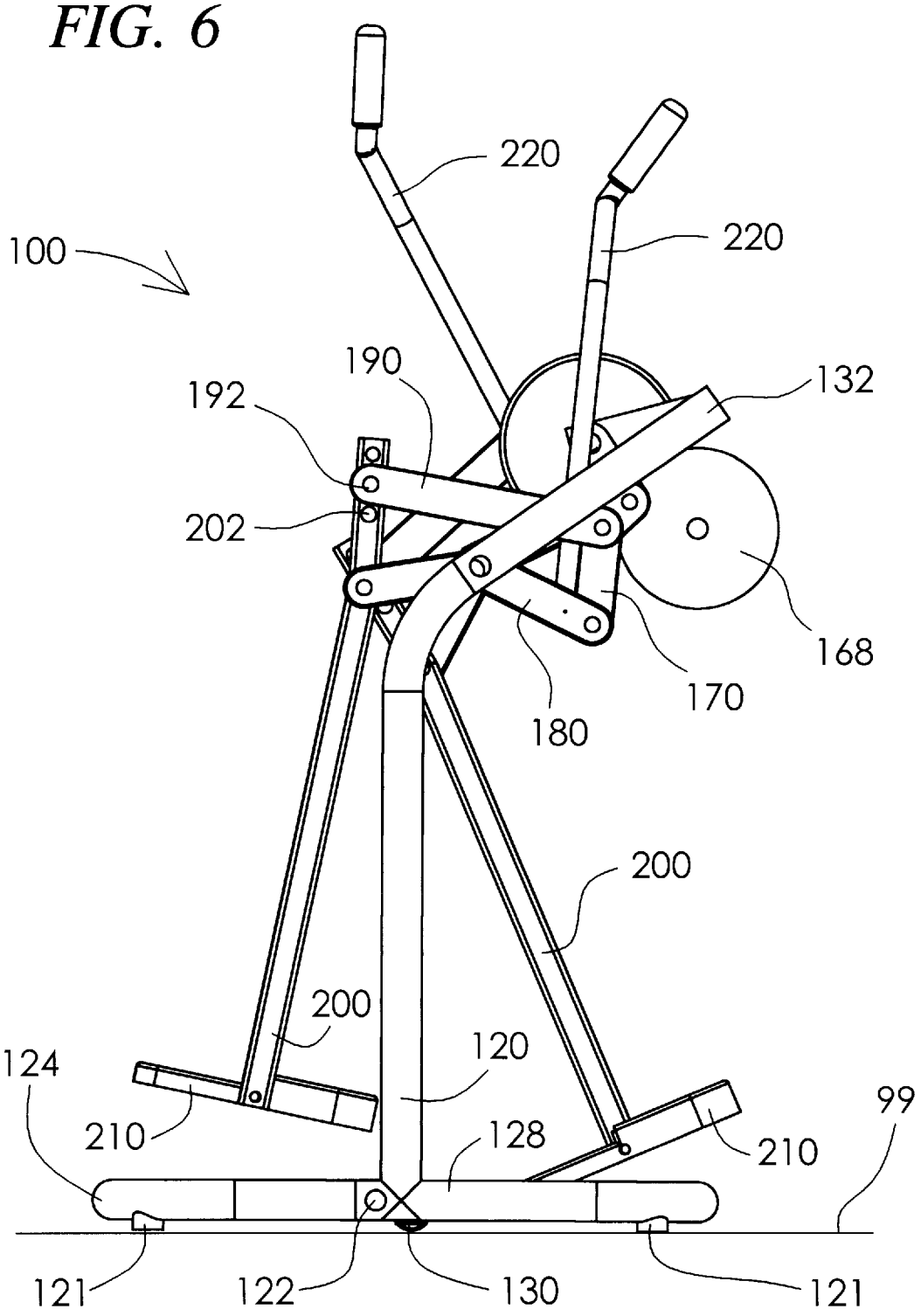
FIG. 6 is an opposite side view of the exercise apparatus of FIG. 1.
Figure 7:
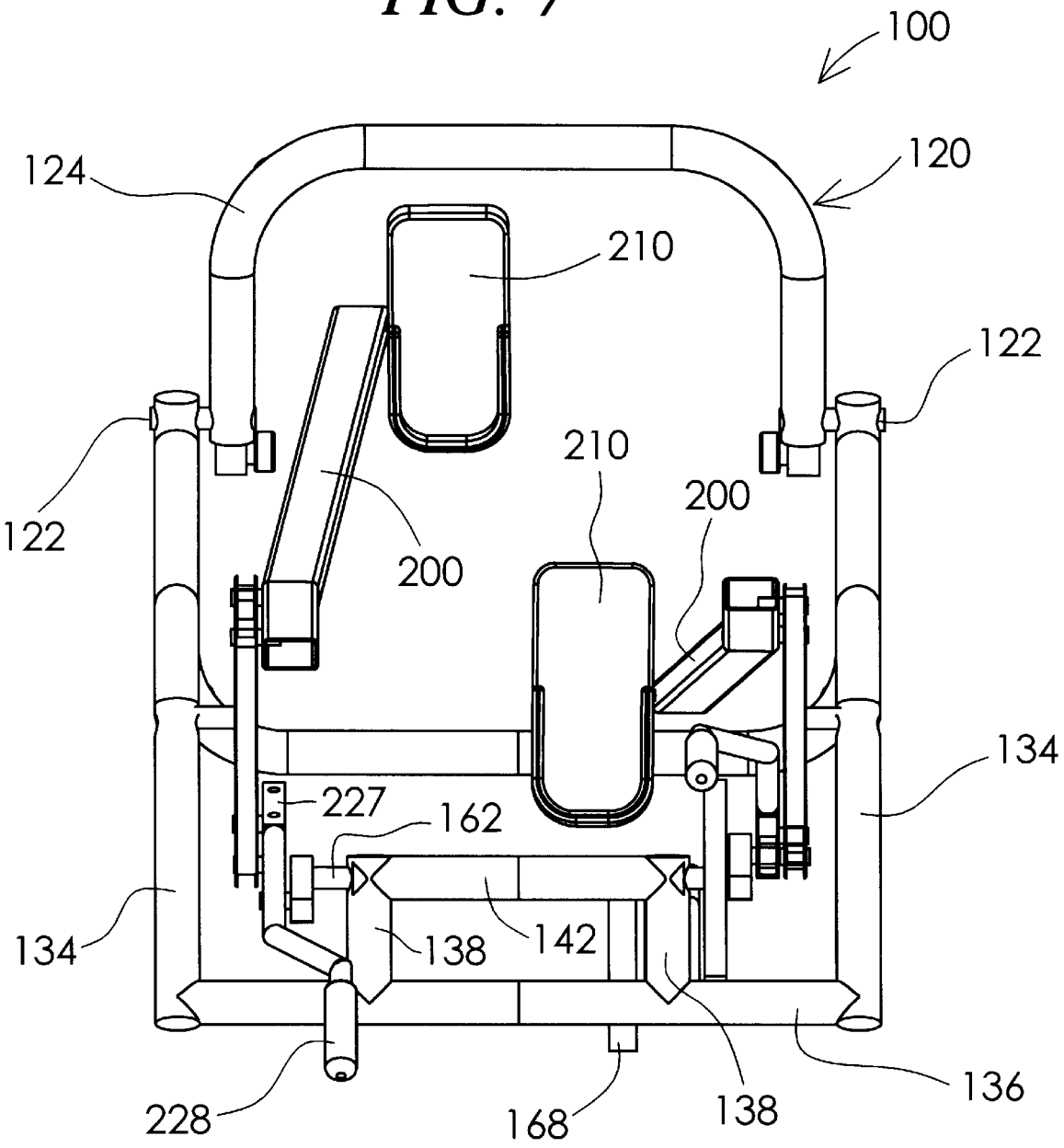
FIG. 7 is a top view of the exercise apparatus of FIG. 1.
Figure 8A:
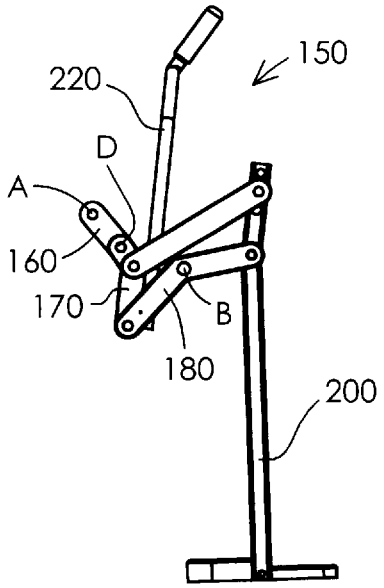
FIG. 8*a* is a side view showing a first orientation of a linkage assembly on the exercise apparatus of FIG. 1.
Figure 8B:
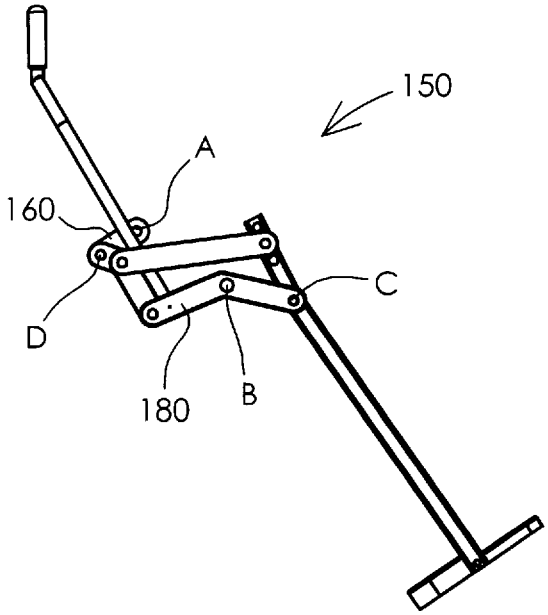
FIG. 8*b* is a side view showing a second orientation of a linkage assembly on the exercise apparatus of FIG. 1.
Figure 8C:
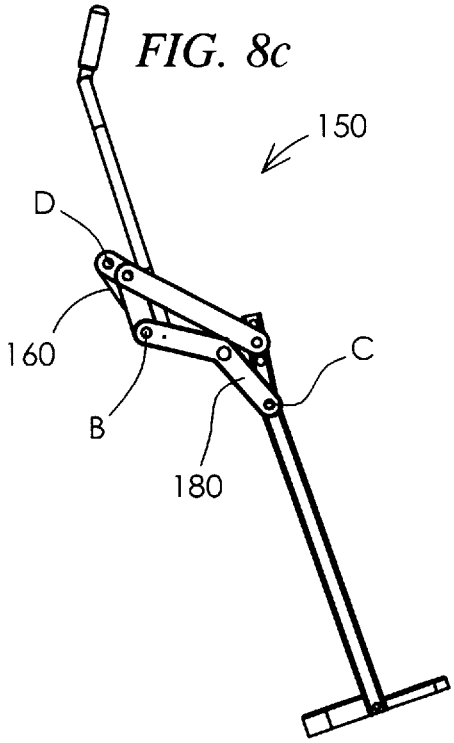
FIG. 8*c* is a side view showing a third orientation of a linkage assembly on the exercise apparatus of FIG. 1.
Figure 8D:
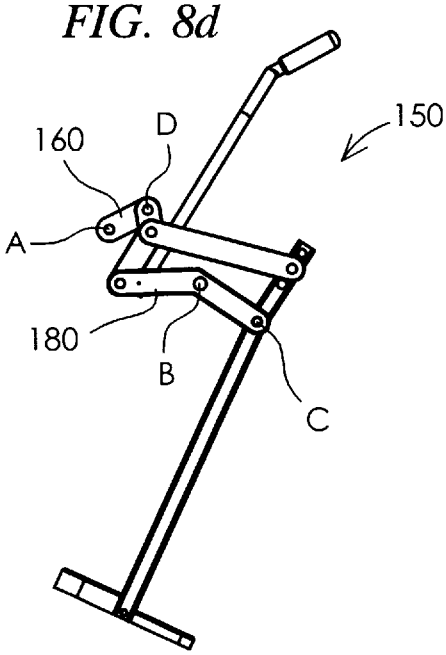
FIG. 8*d* is a side view showing a fourth orientation of a linkage assembly on the exercise apparatus of FIG. 1.

A preferred embodiment exercise apparatus constructed according to the principles of the present invention is designated as 100 in FIGS. 1–8*d*. The exercise apparatus 100 generally includes a linkage assembly 150 movably mounted on a frame 120. Generally speaking, the linkage assembly 150 moves relative to the frame 120 in a manner that links rotation of a crank 160 to generally elliptical motion of a force receiving member 180 or 220. The term "elliptical motion" is intended in a broad sense to describe a closed path of motion having a relatively longer first axis and a relatively shorter second axis (which extends perpendicular to the first axis).

The frame 120 generally includes a first or rearward, U-shaped base member 124, a second or forward, U-shaped base member 128, and a third, upwardly extending support 132. The rearward base member 124 has distal ends which nest within distal ends of the forward base member 128. The base members 124 and 128 are rotatably connected to one another by means of fasteners 122 which extend through aligned holes in the distal ends of the base members 124 and 128. Rollers 130 are rotatably connected to the distal ends of the rearward base member 124, intermediate the fasteners 122 and the extreme ends of the rearward base member 124.

The rearward base member 124 may be selectively rotated or folded relative to the forward base member 128 to make the apparatus 100 more compact for purposes of storage and/or transportation. However, in order to collapse the frame 120 in this manner, the rollers 130 must be driven "over center" relative to the fasteners 122. When the frame 120 is collapsed, the rollers 130 provide a convenient means for moving the apparatus 100 from one place to another, because rearward tilting of the apparatus 100 places all of the weight on the rollers 130. A locking mechanism, such as clip or pin arrangement, may be provided to secure the rearward frame member 124 in either position relative to the forward frame member 128.

The upwardly extending support 132 may also be described as an inverted generally U-shaped member. In particular, a transverse member 136 extends between upper ends of a pair of generally L-shaped members or posts 134. The lower ends of the post 134 are rigidly secured to the forward base member 128 proximate the distal ends thereof, and the posts 134 extend generally perpendicularly away from the forward base member 128 and then angle or curve forward to join the transverse member 136. In other words, when the base member 128 lies horizontally upon the floor surface 99, with the pads 121 engaging the floor surface 99, the support 132 extends generally vertically up from the floor surface 99.

Supports 138 (see FIG. 4) extend rearward and downward from opposite sides of the transverse member 136 to support a tube 142 which functions as a housing and bearing assembly for a crank shaft 162. The tube 142 also may be seen to provide a support which may be grasped by a person exercising on the apparatus 100.

The linkage assembly 150 generally includes left and right cranks 160, left and right first links 170, left and right second links 180, left and right third links 190, and left and right fourth links 200. The cranks 160 and the links 170, 180, 190, and 200 on the left side of the apparatus 100 are 180 degrees out of phase with their counterparts on the right side of the apparatus 100. However, those skilled in the art will recognize that other relative orientations may be implemented without departing from the scope of the present invention.

On each side of the apparatus 100, a crank 160 is rotatably mounted to the support 132 via the common shaft 162. In particular, the cranks 160 are rigidly secured to the shaft 162 and rotate together therewith (about an axis A) relative to the frame 120. A relatively large diameter pulley 165 is also rigidly secured to the shaft 162, proximate the left crank 160. A closed loop or belt 166 connects the large pulley 165 to a relatively small pulley 167 which, together with a flywheel 168, is rotatably mounted relative to a support extending (in cantilevered fashion) forward and downward from the transverse member 136. The result is a "stepped-up" flywheel 168 which rotates faster than the crank shaft 162 and the cranks 160.

The first link 170 has a first end rotatably connected to the crank 160 at a radial distance from the crank axis A. The first link 170 has a second, opposite end rotatably connected to an end of the second link 180. An opposite end of the second link 180 is rotatably connected to an intermediate portion of the fourth link 200. An intermediate portion of the second link 180 is rotatably connected to the support 132 just above the bend in the post 134. As a result, the second link 180 is constrained to pivot about an axis B relative to the frame 120.

The third link 190 is rotatably interconnected between an intermediate portion of the first link 170 and an upper end of the fourth link 200. A force receiving member or foot platform 210 is rigidly secured to an opposite, lower end of the fourth link 200. Those skilled in the art will recognize that the platform 210 could alternatively be movably connected to the link 200 without departing from the scope of the present invention. In any event, the platform 210 is sized and configured to support a person's foot. The links 170, 180, 190, and 200 cooperate to define a four bar linkage which may be said to be movably connected to the frame 120 and/or interconnected between the force receiving member 210, the crank 160, and the frame 120.

The fourth link 200 may be described as relatively longer than the other links 170, 180, and 190 in the linkage and as providing exclusive support for the force receiving member 210. In particular, the fourth link 200 is sized and configured to extend substantially from the foot to the hip of a man of average height (approximately thirty-two inches). The fourth link 200 may also be said to be disposed or suspended rearward of the "linkage-to-frame connection points" or axes A and B.

Rotation of the cranks 160 relative to the frame 120 causes the foot platforms 210 to move through a generally elliptical path of motion, points of which are shown in FIGS. 8*a*–8*d* (it being recognized that the axes A and B are fixed relative to the frame). The fourth link 200 may be described as pivoting about an axis C which, in turn, pivots about the axis B. Also, as illustrated by FIGS. 8*a*–8*d,* the first link 170 and the handle 220 extend generally parallel to the fourth link 200 throughout the exercise motion. Furthermore, due to the rigid connection therebetween, the platform 210 and the fourth link 200 extend generally perpendicular to one another at all times.

The point of connection between the third link 190 and the fourth link 200 may be adjusted along the latter to alter the path of motion. In particular, at least one hole extends through the third link 190, and a series of holes 202 extend through the fourth link 200, proximate the upper end thereof (opposite the force receiving member 210). A fastener 192 inserts through the hole in the third link 190 and any one of the holes 202 through the fourth link 200 to rotatably interconnect the two links 190 and 200. Those skilled in the art will recognize that other adjustment arrangements, such as a lead screw, either manually operated or motorized, could be substituted for the fasteners 192 and the holes 202.

Handle members 220 are provided on the preferred embodiment 100 in such a manner that they move together with the first links 170 as the cranks 160 rotate, and as the force receiving members 210 move through generally elliptical paths of motion. In particular, each handle member 220 has a lower end 227 which is rigidly secured to a respective first link 170, and an opposite, upper end 228 which is sized and configured to be grasped by a person standing on the foot supports 210. As a result, each handle member may be described as pivoting about an axis D which, in turn, rotates about an axis A. As illustrated in FIGS. 8*a*–8*d*, the handle member 220 crosses or moves through the axis A during an exercise cycle. In this regard, the handle members 220 may be said to be a second, discrete force receiving member which travels through a generally elliptical path of motion. Those skilled in the art will recognize that the handle members 220 could be connected to other components of the apparatus 100 to provide different forms of arm exercise. For example, the handle members 220 could be secured to the third links 190 or directly to the frame 120 and either move relative thereto or be rigidly secured.

Those skilled in the art will also recognize that each of the components of the linkage assembly 150 is sized and configured to facilitate the depicted interconnections in a relatively efficient manner. For example, the second link 180 and the third link 190 need only be long enough to extend between and interconnect the first link 170 and the fourth link 200. Furthermore, for ease of reference in both this detailed description and the claims set forth below, the components are sometimes described with reference to "ends" being connected to other parts. For example, the third link 190 may be said to have a first end rotatably connected to the first link 170 and a second end rotatably connected to the fourth link 200. However, those skilled in the art will recognize that the present invention is not limited to links which terminate immediately beyond their points of connection with or extend directly between other parts. In other words, the term "end" should be interpreted broadly, in a manner that could include "rearward portion", for example; and in a manner wherein "rear end" could simply mean "behind an intermediate portion", for example. Moreover, the links need not extend directly between their points of connection with other parts. Indeed, it may be desirable to curve the elongate links 200, for example, in order to enhance collapsibility of the rearward base member 124.

Those skilled in the art will also recognize additional embodiments, modifications, and/or applications which differ from those described herein yet nonetheless fall within the scope of the present invention. For example, other types of inertia altering and/or resistance devices, such as a band brake or a motor, could be added to or substituted for the flywheel arrangement without departing from the scope of the present invention. Furthermore, the size, configuration, and/or arrangement of the components of the preferred embodiment may be modified as a matter of design choice. For example, the linkage assembly 150 could be movably mounted to a variety of frame arrangements which may appear quite different than that of the preferred embodiment 100. Recognizing that, for reasons of practicality, the foregoing description sets forth only some of the numerous possible modifications and variations, the scope of the present invention is to be limited only to the extent of the claims which follow.

What is claimed is:

1. An exercise apparatus, comprising:

a frame;

a left crank and a right crank, wherein each said crank is rotatably mounted on the frame;

a left first link and a right first link;

a left second link and a right second link;

a left third link and a right third link;

a left fourth link and a right fourth link; and a left foot supporting force receiving member and a right foot supporting force receiving member, wherein each said first link has a first end rotatably connected to a respective crank; and each said second link has a first end rotatably connected to a second, opposite end of a respective first link, an intermediate portion rotatably connected to the frame, and a second, opposite end rotatably connected to an intermediate portion of a respective fourth link; and each said third link has a first end rotatably connected to an intermediate portion of a respective first link, and a second, opposite end rotatably connected to a first end of a respective fourth link; and each said force receiving member is connected to at least one of a respective first link, second link, third link, and fourth link.

2. The exercise apparatus of claim 1, wherein each said force receiving member is a foot platform connected to a second, opposite end of a respective fourth link.

3. The exercise apparatus of claim 1, further comprising a first handle connected to the left first link, and a second handle connected to the right first link.

4. The exercise apparatus of claim 3, wherein each said handle extends generally parallel to a respective fourth link throughout an exercise cycle.

5. The exercise apparatus of claim 3, wherein each said crank rotates about an axis, and each said handle moves through the axis during an exercise cycle.

6. The exercise apparatus of claim 1, wherein each said force receiving member moves in an arc about a first axis which, in turn, moves in an arc about a second axis.

7. The exercise apparatus of claim 1, wherein each said second link pivots about a horizontal axis relative to the frame, and throughout an exercise cycle, a respective first link remains to one side of a vertical plane containing the horizontal axis, and the upper end of a respective fourth link remains to an opposite side of the vertical plane.

8. The exercise apparatus of claim 1, wherein each said second link and a respective third link extend generally parallel to one another throughout an exercise cycle.

9. The exercise apparatus of claim 1, wherein the second end of each said third link is selectively secured in one of several positions along a respective fourth link.

10. The exercise apparatus of claim 1, wherein at least one hole extends through the second end of each said third link, and a plurality of holes extend through the first end of each said fourth link, and a first fastener is selectively inserted through the single hole in the left third link and any one of the plurality of holes in the left fourth link to rotatably connect the left third link to the left fourth link, and a second fastener is selectively inserted through the single hole in the right third link and any one of the plurality of holes in the right fourth link to rotatably connect the right third link to the right fourth link.

* * * * *